US011708727B2

(12) United States Patent
Stephen et al.

(10) Patent No.: US 11,708,727 B2
(45) Date of Patent: Jul. 25, 2023

(54) CONNECTION SYSTEM FOR A MARINE DRILLING RISER

(71) Applicant: Oil States Industries (UK) Limited, Aberdeen (GB)

(72) Inventors: Garry Stephen, Montrose Tayside (GB); Richard Johnston, Linlithgow Lothian (GB); David Symonds, Uphall Lothian (GB); Gordon Wallace, Aberdeen (GB)

(73) Assignee: OIL STATES INDUSTRIES (UK) LIMITED, Aberdeen (GB)

( * ) Notice: Subject to any disclaimer, the term of this patent is extended or adjusted under 35 U.S.C. 154(b) by 209 days.

(21) Appl. No.: 17/275,425

(22) PCT Filed: Sep. 18, 2019

(86) PCT No.: PCT/GB2019/052630
§ 371 (c)(1),
(2) Date: Mar. 11, 2021

(87) PCT Pub. No.: WO2020/058710
PCT Pub. Date: Mar. 26, 2020

(65) Prior Publication Data

US 2022/0098935 A1 Mar. 31, 2022

(30) Foreign Application Priority Data

Sep. 18, 2018 (GB) ..... 1815150

(51) Int. Cl.

| | |
|---|---|
| ***E21B 17/02*** | (2006.01) |
| ***E21B 17/08*** | (2006.01) |
| ***E21B 19/00*** | (2006.01) |

(52) U.S. Cl.
CPC ..... *E21B 17/0853* (2020.05); *E21B 17/028* (2013.01); *E21B 17/085* (2013.01); *E21B 19/006* (2013.01)

(58) Field of Classification Search
CPC ..... E21B 17/028; E21B 17/085; E21B 17/0853; E21B 19/006
See application file for complete search history.

(56) References Cited

U.S. PATENT DOCUMENTS

| | | | | |
|---|---|---|---|---|
| 4,403,658 A | | 9/1983 | Watkins | |
| 4,668,126 A | * | 5/1987 | Burton | E21B 19/002 166/341 |

(Continued)

FOREIGN PATENT DOCUMENTS

| | | |
|---|---|---|
| WO | 2011059340 | 5/2011 |
| WO | 2014120130 | 8/2014 |

OTHER PUBLICATIONS

Patent Cooperation Treaty; PCT/GB2019/052630; Jan. 7, 2020; ISR and Written Opinion.

*Primary Examiner* — Matthew R Buck
(74) *Attorney, Agent, or Firm* — Morgan, Lewis & Bockius LLP

(57) ABSTRACT

The present invention concerns a connection system 1 for a marine drilling riser 10 having one or more auxiliary lines 20, the connection system comprising: a moveable coupling member 30 having at least one first connector and at least one second connector coupled to the at least one first connector, wherein the at least one second connector is adapted for engaging with at least one connector of an auxiliary line of the marine drilling riser The connection system further comprising a control line support 18 for fixing at or adjacent an outer surface of the marine drilling riser; a control line supported by the control line support and (Continued)

for attachment to the moveable coupling member; and a tailing line for attachment to the moveable coupling member.

24 Claims, 9 Drawing Sheets

(56) References Cited

U.S. PATENT DOCUMENTS

| | | | | |
|---|---|---|---|---|
| 8,267,179 | B2 * | 9/2012 | Butcher | F16L 1/26 166/341 |
| 8,403,065 | B2 * | 3/2013 | Taylor | E21B 17/046 166/356 |
| 8,505,980 | B2 * | 8/2013 | Vatne | E21B 17/01 285/27 |
| 8,813,851 | B2 * | 8/2014 | Varley | E21B 17/085 166/345 |
| 9,518,451 | B2 * | 12/2016 | Luppi | E21B 19/16 |
| 9,702,205 | B2 * | 7/2017 | Jansen | E21B 19/002 |
| 9,719,310 | B2 * | 8/2017 | MacGregor | E21B 17/01 |
| 2014/0083711 | A1 | 3/2014 | Springett et al. | |

* cited by examiner

CONNECTION SYSTEM FOR A MARINE DRILLING RISER

The present invention relates particularly but not exclusively to a connection system for use in the moon pool area of an offshore vessel or other floating facility, for connecting drape lines or hoses to the auxiliary lines of a marine drilling riser of a subsea oil or gas well.

BACKGROUND

Subsea oil or gas wells are conventionally drilled by running a drill string from an offshore vessel or other floating facility through a marine drilling riser, which extends from the surface to the blowout preventer (BOP) and wellhead on the seafloor. The marine drilling riser is typically installed and operated from a surface vessel with a moon pool located generally in its centre, where all equipment that is required to install and operate the marine drilling riser can be lowered from the surface vessel through the moon pool into the sea and down to the wellhead on the seafloor.

The marine drilling riser has a bore which contains the drill string casing, which itself has a bore through which the drill string is run. Drilling fluids such as mud are circulated down the bore of the drill string casing to the drill bit at the bottom end of the drill string, and then back to the surface through the annulus between the drill string casing and marine drilling riser.

In addition to the main bore of the marine drilling riser, a typical riser will also carry a number of external auxiliary lines or conduits on its outer surface, usually between four and eight. These auxiliary lines can be used to either transfer other fluids such as choke and kill fluids between the surface and the BOP and wellhead, or they may carry electrical or hydraulic power or control lines for equipment at the wellhead, often the BOP. The connections between the marine drilling riser's auxiliary lines and the surface vessel are conventionally made with detachable flexible lines called drape hoses.

Two important components of a typical marine drilling riser are the telescopic joint and the tension ring. The telescopic joint typically consists of inner and outer sleeves which can move relative to each other, which allows for variation in the length of the marine drilling riser to compensate for ocean swell or heave, which causes the vertical position of the surface vessel to alter relative to the wellhead which is fixed in place on the seafloor. The tension ring is located above the telescopic joint and supports the upper end of the marine drilling riser. The purpose of the tension ring is to maintain the correct level of tension across the length of the riser, compensating for factors such as the depth of the seafloor (and therefore the weight of the riser), and the physical properties of the fluids conveyed through the riser at any given time.

On conventional marine drilling risers, the drape hoses must be manually connected and disconnected from gooseneck connectors located on the outer surface of the riser which are joined to the auxiliary lines of the riser. This typically requires man-riding operations over the surface of the moon pool, which can present a significant degree of risk to personnel, and which can be limited to periods of favourable weather.

There is also known machinery available for docking drape hoses with the auxiliary lines of a marine drilling riser that does not require such manual intervention, but such machinery is typically mechanically complex with many moving parts and includes both mechanical and hydraulic actuation systems. It is therefore expensive and requires significant operating space.

The present invention therefore seeks to provide a connection system for connecting drape lines or hoses to the auxiliary lines of a marine drilling riser which removes the need for personnel to work in a high-risk environment, and which is mechanically simple and reliable.

SUMMARY

According to the present invention there is provided a connection system for a marine drilling riser having one or more auxiliary lines, the connection system comprising a moveable coupling member having at least one first connector and at least one second connector coupled to the at least one first connector, wherein the at least one second connector is adapted for engaging with at least one connector of an auxiliary line of the marine drilling riser; the connection system further comprising a control line support for fixing at or adjacent an outer surface of the marine drilling riser; a control line supported by the control line support and for attachment to the moveable coupling member; and a tailing line for attachment to the moveable coupling member.

The present invention therefore improves safety by providing a connection system which allows for remote connection and disconnection of drape lines or hoses to the auxiliary lines of a marine drilling riser without the need for undue manual intervention either above the moon pool or near the riser. The drape hoses can be connected to the coupling member while it is located in a safe working environment removed from the riser, such as the moon pool floor. Furthermore, the present invention provides a connection system for connecting drape lines or hoses to the auxiliary lines of a marine drilling riser which is mechanically simple and reliable, which offers improved resiliency to operation in inclement weather conditions, and which can be retrofitted to existing marine drilling riser systems.

Optionally the control line support comprises a pulley.

Optionally the control line and the tailing line are attached to the moveable coupling member at different locations on the coupling member, optionally at locations substantially spaced from each other, optionally at locations at opposing ends of the coupling member. Optionally at least one, or optionally both, of the control line and the tailing line are attached to the moveable coupling member at a location substantially spaced from the centre of gravity of the coupling member.

Optionally the control line support is fixed to a tension ring of the marine drilling riser, optionally to a lower surface of the tension ring. Optionally the outer diameter of the tension ring is greater than the outer diameter of a telescopic joint of the marine drilling riser; optionally the control line support is fixed to the tension ring inside the outer diameter of the tension ring but outside the outer diameter of the telescopic joint. Optionally the control line support is fixed to the tension ring only slightly outside the outer diameter of the telescopic joint. Optionally the control line support is fixed to a structural member of the tension ring, optionally adjacent to a pad eye of the tension ring.

Optionally the at least one second connector of the moveable coupling member engages (optionally sealingly engages) with the at least one connector of an auxiliary line of the marine drilling riser by an upward, optionally a vertically upward, relative sliding movement of the moveable coupling member in the direction of an axis of the bore of the riser. Alternatively the at least one second connector of the moveable coupling member engages (optionally sealingly engages) with the at least one connector of an auxiliary line of the marine drilling riser by a downward, optionally a vertically downward, relative sliding movement of the moveable coupling member in the direction of an axis of the bore of the riser.

Optionally the relative sliding movement of the moveable coupling member is guided by a first guidance means on an outer surface of the marine drilling riser, optionally on an outer surface of the telescopic joint of the marine drilling riser. Optionally the first guidance means comprises guide tracks or rails. Optionally the first guidance means comprise bearing faces. Optionally the moveable coupling member engages with the first guidance means without external intervention. Optionally once the moveable coupling member is engaged with the first guidance means, the movement of the moveable coupling member is urged toward a single degree of freedom, optionally parallel to an axis of the riser. Optionally the first guidance means is adapted to be installable on an existing marine drilling riser, for example by being clamped around an outer circumference of an existing marine drilling riser.

Optionally the moveable coupling member comprises one or more conduits (optionally one or more tubulars) joined between, and optionally in fluid communication with, respective at least one first connectors and at least one second connectors. Optionally the conduits are gooseneck tubing sections, optionally U-bend tubing sections. Optionally the conduits comprise a bore. Optionally the conduits comprise a housing, optionally containing one or more cables or other electrical conductors. Optionally the one or more conduits and respective first and second connectors are held in position with respect to each other by one or more framing plates. Optionally each conduit passes through an aperture in each of the one or more framing plates. Optionally each conduit passes through a cut out in an edge of each of the one or more framing plates. Optionally the one or more conduits are held parallel with respect to each other by the one or more framing plates. Optionally the one or more conduits are all held in alignment with respect to a longitudinal axis of the conduits by the one or more framing plates.

Optionally the moveable coupling member also comprises a rod element which protrudes therefrom and which can pass through an aperture in each of the one or more framing plates. Optionally the rod element is held parallel to the conduits by the one or more framing plates. Optionally the rod element has a greater longitudinal dimension than any of the at least one conduits. Optionally the rod element is for moving through one or more apertures disposed in one or more annular plates fixed to an outer surface of the telescopic joint. Optionally the rod element and the one or more apertures disposed in the one or more annular plates form a complementary second guidance means with the first guidance means. Optionally the second guidance means facilitates proper axial alignment of the at least one second connector of the moveable coupling member with the at least one connector of an auxiliary line of the marine drilling riser. Optionally the second guidance means is adapted to be installable on an existing marine drilling riser.

Optionally the at least one second connector of the moveable coupling member is a stab connector. Optionally the at least one connector of an auxiliary line of the marine drilling riser is a female receptacle connector adapted to receive a stab connector of the moveable coupling member. Optionally the at least one second connector of the moveable coupling member sealingly engages by means of a sealing mechanism with the at least one connector of an auxiliary line of the riser. Optionally the sealing mechanism locks the at least one second connector of the moveable coupling member to the at least one connector of an auxiliary line of the riser, optionally to substantially prevent movement (optionally vertical movement) of the connectors relative to each other. Optionally the sealing mechanism may be hydraulic, or optionally the sealing mechanism may be manual.

Optionally the at least one second connector of the moveable coupling member comprises an electrical connector, and optionally the at least one first connector of the moveable coupling member comprises an umbilical connector. Optionally the at least one second connector comprises a plurality of electrical conductors, which are optionally isolated from one another, and are optionally individually adapted to form electrical connections. Optionally at least one of the plurality of electrical conductors is an electrical power connector, or optionally an electrical control connector, or optionally an electrical signalling connector.

Optionally the control line is permanently attached to the control line support. Optionally the control line is attached to a forward portion of the moveable coupling member, optionally proximate the at least one second connector; optionally the tailing line is attached to a rearward portion of the moveable coupling member, optionally spaced from the at least one second connector. Optionally the control line is attached to a rearward portion of the moveable coupling member, optionally spaced from the at least one second connector; optionally the tailing line is attached to a forward portion of the moveable coupling member, optionally proximate the at least one second connector. Optionally the tailing line is manipulated to further control the movement of the moveable coupling member as it is raised toward the marine drilling riser by the control line.

Optionally the control line is tensioned by a powered means, optionally by a winch, optionally by an air winch. Optionally the powered means may be manually controlled, or may optionally be automated, for example controlled by an autonomous system.

Optionally the tailing line is tensioned by mechanical means, for example by a windlass. Optionally the tailing line is tensioned by a powered means, optionally by a winch.

Optionally the control line and the tailing line are stowed after the moveable coupling member has been run in and the at least one second connector of the moveable coupling member has engaged, optionally sealed, optionally locked, with the at least one connector of an auxiliary line of the riser. Optionally the procedure to release and detach the moveable coupling member from the marine drilling riser is a reversal of the procedure to attach and engage the moveable coupling member with the riser.

According to another aspect of the present invention there is provided a method of running a moveable coupling member onto a marine drilling riser having one or more auxiliary lines, wherein the moveable coupling member has at least one first connector and at least one second connector coupled to the first connector, and wherein the marine drilling riser has at least one connector of an auxiliary line, a control line support for fixing at or adjacent an outer surface of the marine drilling riser, and a control line supported by the control line support, the method comprising the steps of: attaching the control line to the moveable coupling member; attaching a tailing line to the moveable coupling member; tensioning the control line to raise the moveable coupling member toward the marine drilling riser until the moveable coupling member contacts an outer surface of the marine drilling riser; manipulating the control line to move the moveable coupling member in a direction parallel to an axis of the marine drilling riser; and engaging at least one second connector of the moveable coupling member with at least one connector of an auxiliary line of the marine drilling riser.

Optionally the tailing line can be tensioned to further control the movement of the moveable coupling member as it is raised toward the marine drilling riser.

Optionally the control line is attached to a forward portion of the moveable coupling member proximate the at least one second connector, and optionally the tailing line is attached to a rearward portion of the moveable coupling member proximate the at least one first connector.

Optionally the control line is attached to a rearward portion of the moveable coupling member proximate the at least one first connector, and optionally the tailing line is attached to a forward portion of the moveable coupling member proximate the at least one second connector.

Optionally the coupling member engages a guidance means provided to the marine drilling riser to align the coupling member for connection with the at least one connector of an auxiliary line of the marine drilling riser.

Optionally the at least one second connector of the moveable coupling member is adapted to form a sealed fluid conduit with the at least one connector of the marine drilling riser.

Optionally the at least one second connector of the moveable coupling member is adapted to form an electrical connection with the at least one connector of the marine drilling riser.

BRIEF DESCRIPTION OF THE DRAWINGS

In the accompanying drawings:

FIG. 6*a* also illustrates an up-stab coupling member positioned adjacent to the auxiliary line connectors of the marine drilling riser.

DETAILED DESCRIPTION

Figure 1A:
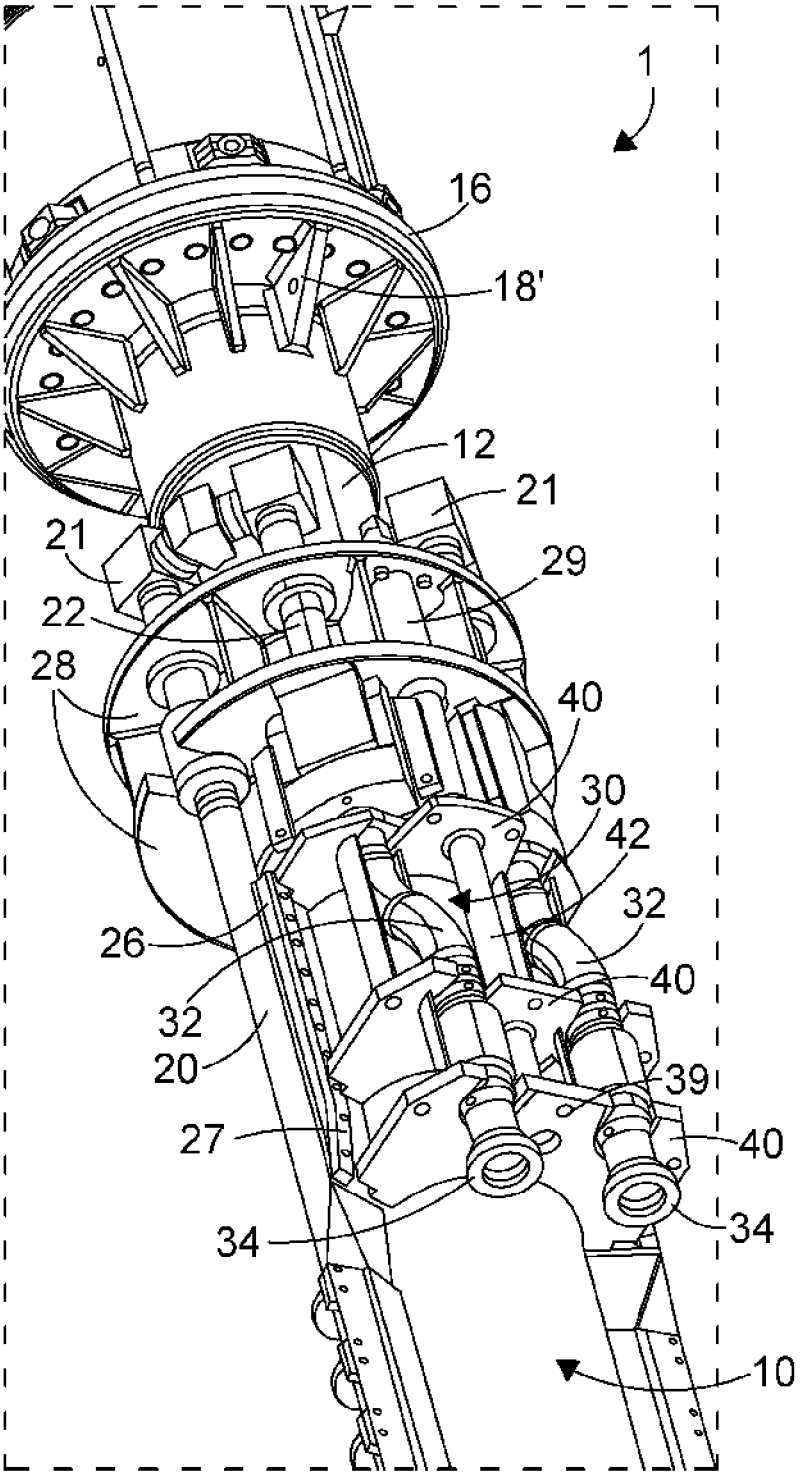
FIGS. 1*a* and 1*b* are lower and upper perspective views of an up-stab coupling member engaged with the auxiliary lines of a marine drilling riser in accordance with a first embodiment of the present invention.
Figure 1B:
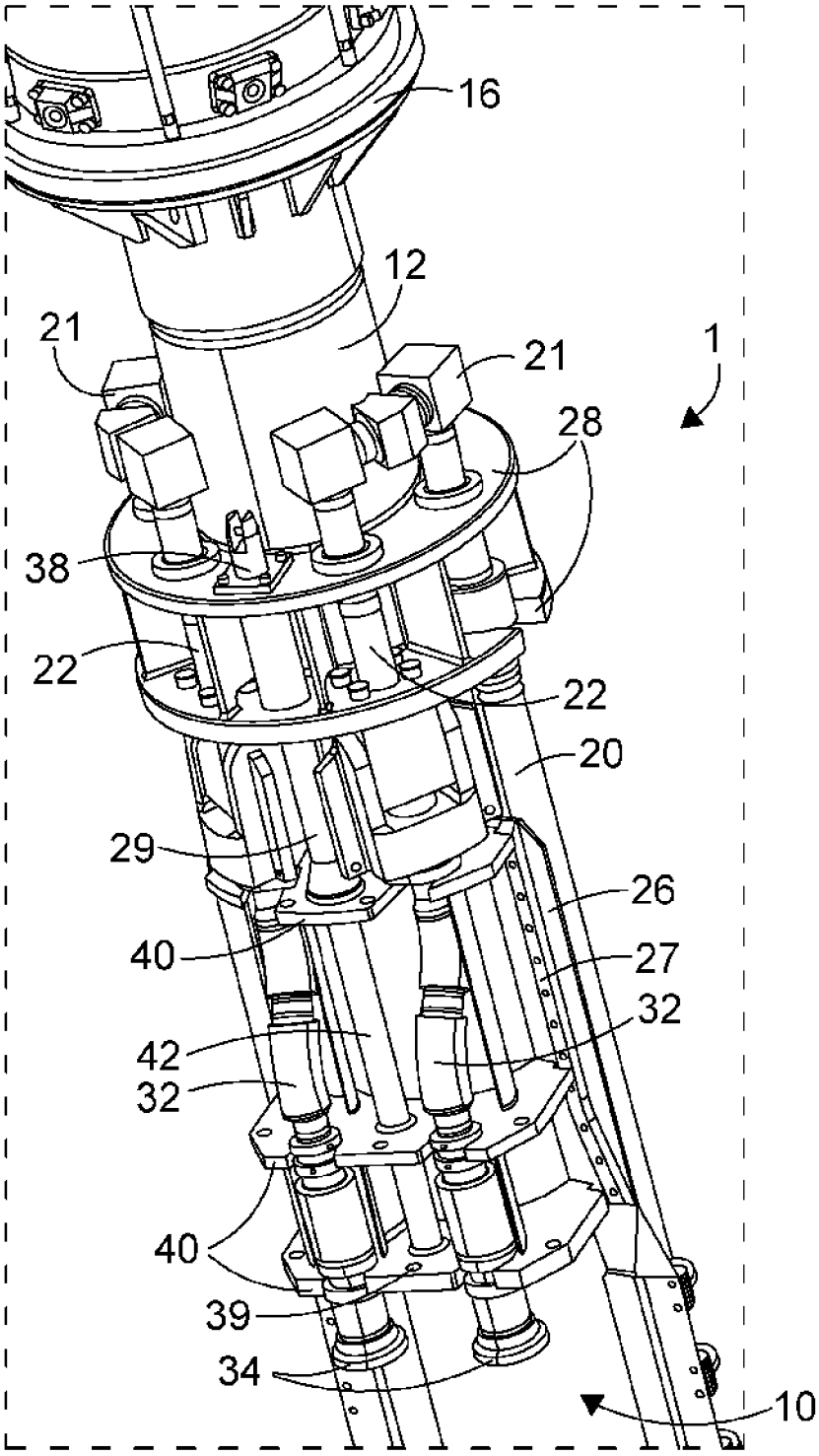
Figure 2:
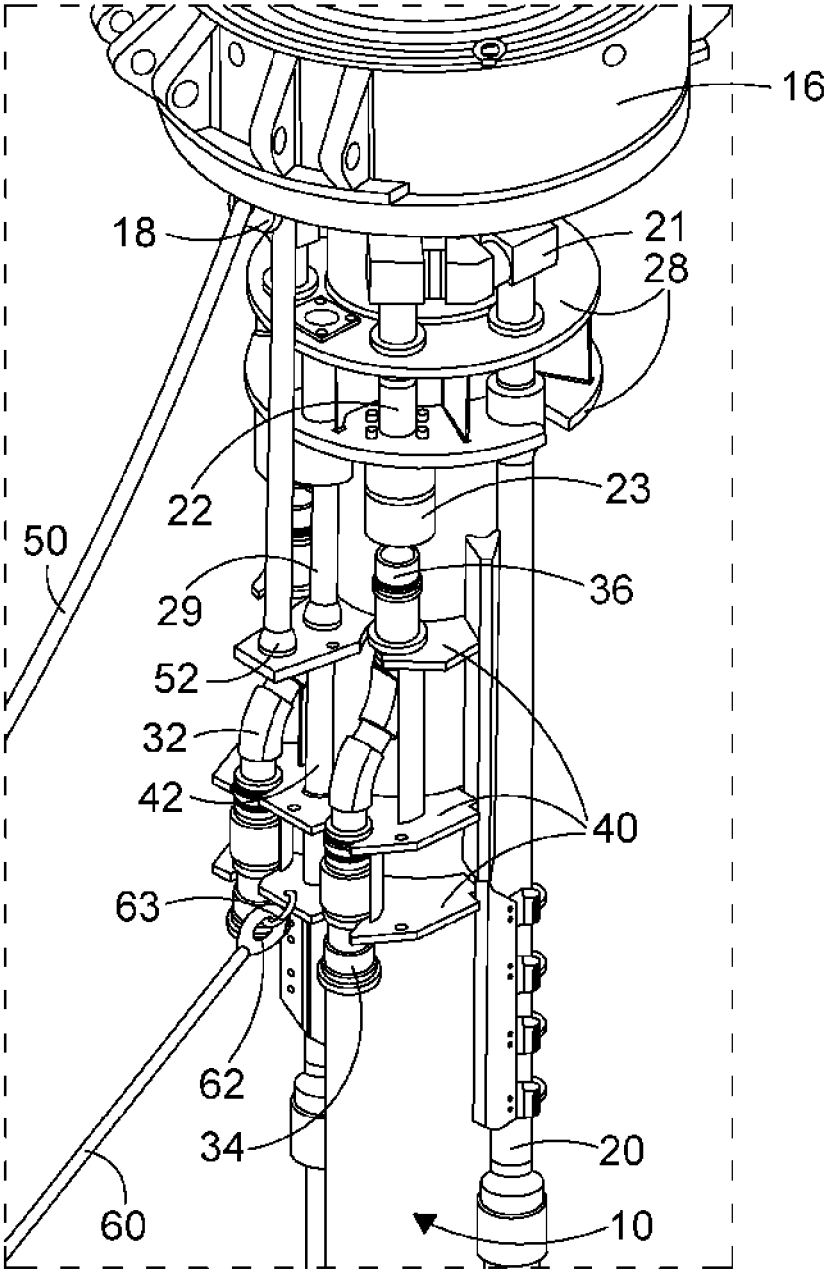
FIG. 2 is another perspective view of the up-stab coupling member being manipulated by a control line and a tailing line before engaging with the auxiliary lines of a marine drilling riser.

Referring now to the drawings, a first example of a connection system 1 is shown in FIGS. 1*a*, 1*b* and 2. The connection system 1 comprises a marine drilling riser 10, a coupling member or bridle 30, a control line 50 and a tailing line 60. The bridle 30 is shown engaged with marine drilling riser 10 in FIGS. 1*a* and 1*b*. The connection system 1 is shown in FIGS. 1*a* and 1*b* without control line 50, tailing line 60 or any external drape lines or hoses.

The marine drilling riser 10 has a bore with an axis and comprises a telescopic joint 12 and a tension ring 16. The tension ring 16 has a bore with an axis which is coaxial to the bore of the riser 10. The tension ring 16 is disposed above the telescopic joint 12. In this example a control line support in the form of a pulley 18, mounted in aperture 18', is disposed on the underside of the tension ring 16, and more particularly is fixed to a structural member on the underside of the tension ring 16, in approximate radial alignment with the outer diameter of the telescopic joint 12. In other examples of connection system 1, other configurations of pulley 18 are possible. One or more auxiliary lines 20 are disposed on the outer surface of the riser 10. In this example two auxiliary lines 20 are shown, but in other examples there may be fewer or more auxiliary lines 20, for example four, six or eight auxiliary lines. Also in this example each auxiliary line 20 has a bore and is disposed parallel to the axis of the bore of the riser 10 along the length of the outer surface of the riser 10, but in other examples the auxiliary lines 20 may be conduits or housings for umbilical or electrical cables or connections, such as electrical power connections, or control or signalling connections. Each auxiliary line 20 is spaced circumferentially around the outer surface of the riser 10. In the first example of a connection system 1, the upper end of each auxiliary line 20 is joined to a pair of consecutive 90-degree connectors 21 disposed on the outer surface of the telescopic joint 12 and proximate the tension ring 16, which connect to auxiliary line end portions 22. In this example the auxiliary line end portions 22 are also disposed on the outer surface of the telescopic joint 12 and lie parallel to their respective connected auxiliary lines 20, but are circumferentially spaced from their respective connected auxiliary lines 20. In other words, in this example the upper end of each auxiliary line 20, the two 90-degree connectors 21 of each auxiliary line 20, and each corresponding auxiliary line end portion 22 form a U-shape.

As can be most clearly seen in FIG. 2, each auxiliary line end portion 22 is joined to an auxiliary line connector 23 at the opposing axial end of the auxiliary line end portion 22 from each pair of 90-degree connectors 21. In this example each auxiliary line connector 23 has a downward-facing opening, a bore and a sealing and locking mechanism and is adapted to receive and sealingly engage with a corresponding auxiliary line connector 36 of the bridle 30, but in other examples one or more of the auxiliary line connectors 23 may be electrical connectors e.g. socket connectors adapted to engage with a corresponding plug connector 36 of the bridle 30. The sealing and locking mechanism of each auxiliary line connector 23 may be actuated by either manual or hydraulic means.

The upper ends of each auxiliary line 20 and each auxiliary line end portion 22 are supported by one or more annular plates 28. In this example there are two annular plates 28, but in other examples there may be fewer or more annular plates 28. Each annular plate 28 is disposed around an outer surface of the telescopic joint 12, toward the upper end of the telescopic joint 12 and adjacent to the underside of the tension ring 16. Each annular plate 28 is orientated so that the plane of each annular plate 28 is perpendicular to the axis of the bore of the riser 10. The auxiliary lines 20 and auxiliary line end portions 22 pass through apertures in the annular plates 28. The annular plates 28 also support a rod or guide sleeve 29 which also passes through an aperture in each annular plate 28. In this example the guide sleeve 29 is disposed circumferentially between the two auxiliary line end portions 22. The guide sleeve 29 has a downward-facing opening and a bore adapted to receive a rod element or guide stab 42 of the bridle 30.

Referring again to FIGS. 1*a* and 1*b*, the marine drilling riser 10 also has two guide rails 26 mounted on the outer surface of the telescopic joint 12. Each guide rail 26 is formed from a plate or fin whose longitudinal axis is parallel to the axis of the bore of the riser 10, and the plane of each guide rail 26 is aligned with a radius of the bore of the riser 10. A track 27 is disposed on the surface of each guide rail 26, which extends along the length of the guide rail 26, and which tapers radially with respect to the axis of the bore of the riser 10 from the lower end of the guide rail 26 toward the upper end of the guide rail. The track 27 on each guide rail 26 is adapted to engage with notches in the framing plates 40 of the coupling member 30, as will be explained in more detail below.

The coupling member or bridle 30 of the first example of a connection system 1 is most clearly seen in FIG. 2. In the first example, the bridle 30 is an up-stab bridle which is adapted to engage with the auxiliary line connectors 23 of the marine drilling riser 10 through upward motion, or in other words, by way of movement toward the tension ring 16, as will also be explained in more detail below.

The up-stab bridle 30 of the first example is shown in FIG. 2 positioned adjacent to and in contact with the telescopic joint 12 of the marine drilling riser 10, but with the auxiliary line connectors 36 of the up-stab bridle 30 not yet engaged with the auxiliary line connectors 23 of the auxiliary line end portions 22. In this example the up-stab bridle 30 comprises two gooseneck tubing sections 32 rigidly supported between three framing plates 40; in other examples the up-stab bridle 30 may have fewer or more gooseneck tubing sections 32 and fewer or more framing plates 40. Also in this example, as is most clearly seen in FIGS. 1*a* and 1*b*, each framing plate 40 has two notches which engage with the tracks 27 on the guide rails 26. When the up-stab bridle 30 is engaged with the guide rails 26, the gooseneck tubing sections 32 are parallel with the axis of the bore of the riser 10 and circumferentially aligned with the corresponding auxiliary line end portions 22 of the riser. Further in this example, when the up-stab bridle 30 is engaged with the guide rails 26, the upper axial ends of the gooseneck tubing sections 32 proximate the auxiliary line connectors 36 are radially displaced from the outer surface of the telescopic joint 12 to a lesser degree than the lower axial ends of the gooseneck tubing sections 32 proximate the drape hose connectors 34. The radial displacement of the upper axial ends of the gooseneck tubing sections 32 from the outer surface of the telescopic joint 12 is equal to the radial displacement of the auxiliary line end portions 22 from the outer surface of the telescopic joint 12, such that the auxiliary line connectors 36 at the upper axial ends of the gooseneck tubing sections 32 are aligned with the auxiliary line connectors 23 of the auxiliary line end portions 22.

The up-stab bridle 30 also comprises an upper anchor or fixing point 38, and a lower anchor or fixing point 39 disposed on the framing plates 40. The two anchor points 38, 39 are adapted to allow the control line 50 and the tailing line 60 to be attached to the up-stab bridle 30. In this example the two anchor points 38, 39 are spaced from one another at opposing ends of the up-stab bridle 30, and are also substantially spaced from the centre of gravity of the up-stab bridle 30, so that the up-stab bridle 30 maintains a stable orientation when suspended from anchor point 38.

In the case of the first example of an up-stab bridle 30, the anchor point 38 closest to the auxiliary line connectors 36 is adapted to allow the control line 50 to be attached to the bridle 30, and the anchor point 39 closest to the drape line connectors 34 is adapted to allow the tailing line 60 to be attached to the up-stab bridle 30.

The control line 50 is also best seen in FIG. 2. In this example the control line 50 is a flexible line or cable of sufficient gauge to accumulatively support the weight of the up-stab bridle 30 and any attached drape hoses, to apply the required insertion force to engage the auxiliary line connectors 36 of the up-stab bridle 30 with the auxiliary line connectors 23 of the riser 10, and to overcome frictional resistance in the movement of the control line 50 through the pulley 18 mounted on the underside of the tension ring 16, and to the motion of the up-stab bridle 30 against the guide rails 26. Also in this example the control line 50 is permanently attached to the pulley 18 mounted on the tension ring 16, although the control line 50 may freely pass through the pulley 18. In other words, neither end of the control line 50 passes through the pulley 18, so that the control line 50 is not removed from the pulley 18. When not in operation, both ends of the control line 50 are stowed in the vicinity of the moon pool of the surface vessel. Further in this example, the end of the control line 50 which connects to the anchor point 38 comprises a detachable connector 52.

The tailing line 60 is also seen in FIG. 2. The tailing line 60 is also a flexible line or cable, but may be a lighter gauge than the control line 50 as the tailing line 60 does not need to support the weight of the up-stab bridle 30, and is instead used to control the motion of the up-stab bridle 30 when the up-stab bridle is suspended on the control line 50. An end of the tailing line 60 is attached to the up-stab bridle 30 when the bridle is positioned in a safe position such as the floor of the moon pool. In other examples the end of the tailing line 60 which attaches to the up-stab bridle 30 may comprise a detachable connector similar to the detachable connector 52 of the control line 50, or as in this example, the tailing line 60 may be terminated with a ferrule or eyelet 62, and may be secured to the anchor point 39 of the up-stab bridle 30 by means of a threaded shackle 63.

Figure 3A:
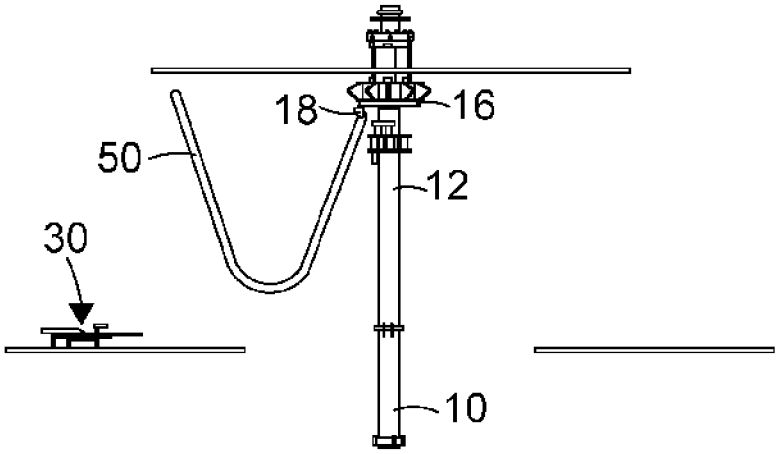
FIGS. 3*a* to 3*f* are sections views of the sequence of steps to run an up-stab coupling member onto a marine drilling riser.

The procedure to run the up-stab bridle 30 onto the marine drilling riser 10 is shown as a sequence of steps in FIGS. 3*a* to 3*f*. In FIG. 3*a* the up-stab bridle 30 is shown at rest on the floor of the moon pool of the surface vessel. Both ends of the control line 50 are shown stowed when not in use. The drape hoses are not shown in any of FIGS. 3*a* to 3*f*, but when the up-stab bridle 30 is shown as in FIG. 3*a*, the drape hose or hoses can be safely connected to the drape hose connectors 34 of the up-stab bridle 30 while the bridle remains within the relatively safe working environment of the moon pool floor.

Figure 3B:
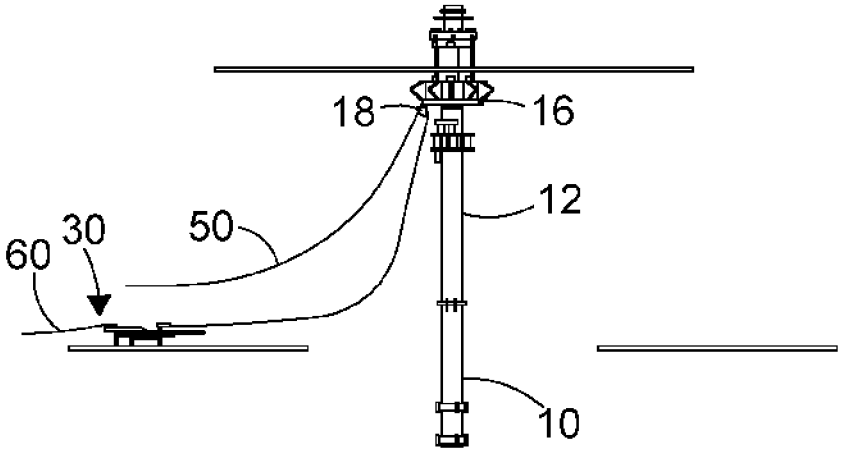

In FIG. 3*b* both ends of the control line 50 are shown removed from their stowed arrangement. In this example the detachable connector 52 at one end of the control line 50 is attached to the anchor point 38 of the up-stab bridle 30, and the ferrule 62 and threaded shackle 63 at one end of the tailing line 60 are attached to the anchor point 39 of the bridle. The other end of the control line 50 not attached the up-stab bridle 30 is attached to a tensioning means such as a winch, not shown in FIG. 3*b*.

Figure 3C:
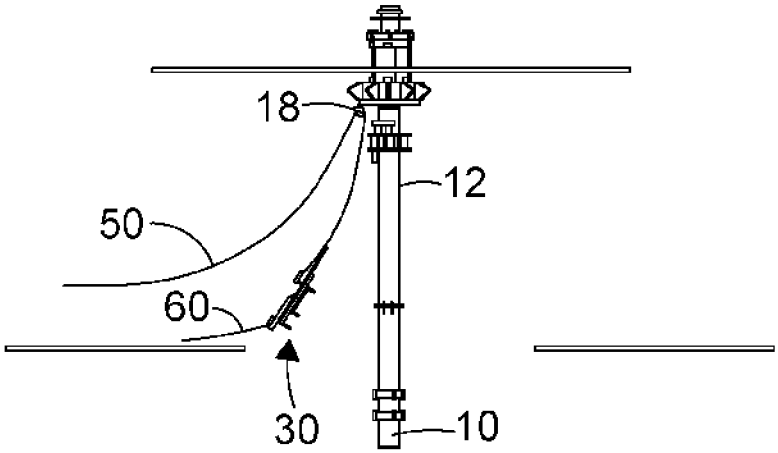

The up-stab bridle 30 is shown in FIG. 3*c* lifted above the surface of the moon pool floor and suspended from the end of the control line 50. As the control line 50 is pulled through the pulley 18 fixed to the underside of the tension ring 16 by the winch or other tensioning means, the up-stab bridle 30 is lifted vertically. Since the up-stab bridle 30 is suspended from the end of the control line 50 passing through the pulley 18, the up-stab bridle 30 will also tend to swing horizontally toward a position vertically below the pulley 18. The horizontal motion of the up-stab bridle 30 when suspended from the control line 50 is controlled by gradually extending the tailing line 60.

Figure 3D:
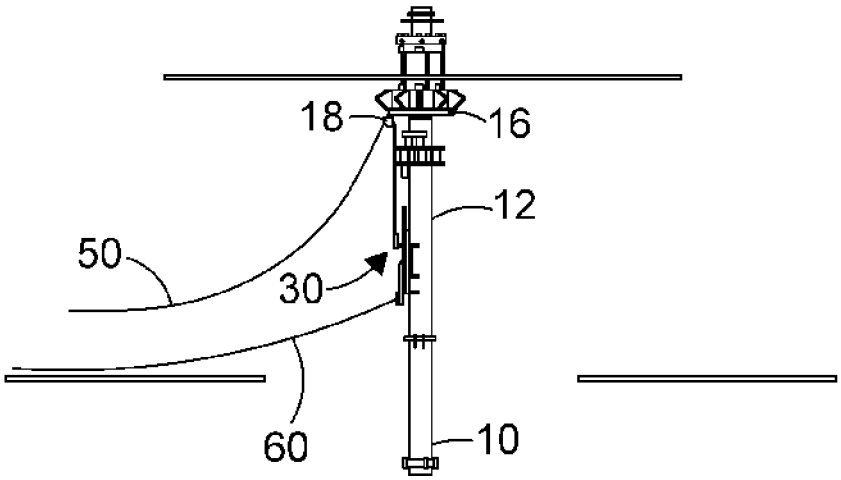

In FIG. 3*d* the up-stab bridle 30 has reached a position vertically below the pulley 18 on the tension ring 16 while still being suspended from the control line 50. As described previously the outer diameter of the tension ring 16 is greater than the outer diameter of the telescopic joint 12. In this example the pulley 18 is fixed to the underside of the tension ring 16 at a location that is radially aligned with the outer diameter of the telescopic joint 12. Therefore, when the up-stab bridle 30 is freely suspended from the pulley 18, it tends toward a horizontal position that is immediately adjacent to the outer surface of the telescopic joint 12. In this position, the notches in the framing plates 40 of the up-stab bridle 30 begin to engage with the guide rails 26 fixed to the outer surface of the telescopic joint 12. The radially inward tapering of the tracks 27 from the lower end of the guide rails 26 allow the guide rails 26 to act as a funnel to capture and engage with the up-stab bridle 30 even if the up-stab bridle 30 is circumferentially removed around the outer diameter of the telescopic joint 12 from an optimal position vertically below the pulley 18. Once the up-stab bridle 30 has made initial engagement with the guide rails 26, the tapering of the tracks 27 up the surface of the guide rails 26 acts to guide the up-stab bridle 30 into an optimal position vertically below the pulley 18 as the up-stab bridle 30 is raised vertically.

Figure 3E:
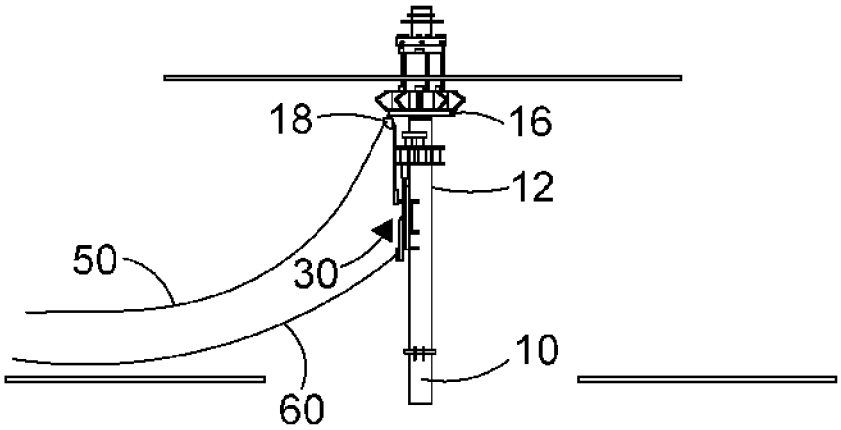

In FIG. 3*e* the up-stab bridle 30 is shown continuing to be raised vertically up the outer surface of the telescopic joint 12. The framing plates 40 of the up-stab bridle 30 are engaged with the guide rails 26 which restrict the movement of the bridle 30 relative to the telescopic joint 12 to vertical movement only, or in other words, to movement that is parallel to the axis of the bore of the marine drilling riser 10. The guide rails 26 engaged with the bridle 30 prevent further horizontal displacement of the bridle 30 perpendicular to the axis of the bore of the riser 10, so that the auxiliary line connectors 36 of the up-stab bridle 30 are vertically aligned with the auxiliary line connectors 23 of the riser 10. Therefore, as the bridle 30 is vertically raised toward its final position on the outer surface of the telescopic joint 12, the auxiliary line connectors 36 of the up-stab bridle 30 engage with the auxiliary line connectors 23 of the riser 10. The auxiliary line connectors 36 of the up-stab bridle are received through the openings of the auxiliary line connectors 23 and into their respective bores. Once the up-stab bridle 30 has been fully raised to the extent of its vertical movement (e.g. fully landed) and the auxiliary line connectors 36 are fully homed within the bores of the auxiliary line connectors 23, the hydraulic sealing mechanisms of the auxiliary line connectors 23 are actuated to seal and lock the connections between the auxiliary line connectors 36 and the auxiliary line connectors 23. Thus, fluid communication is allowed from the drape hoses, through the gooseneck tubing sections 32 of the up-stab bridle 30, through the auxiliary line end portions 22 and 90-degree connectors 21 and into the auxiliary lines 20 of the marine drilling riser 10.

Figure 3F:
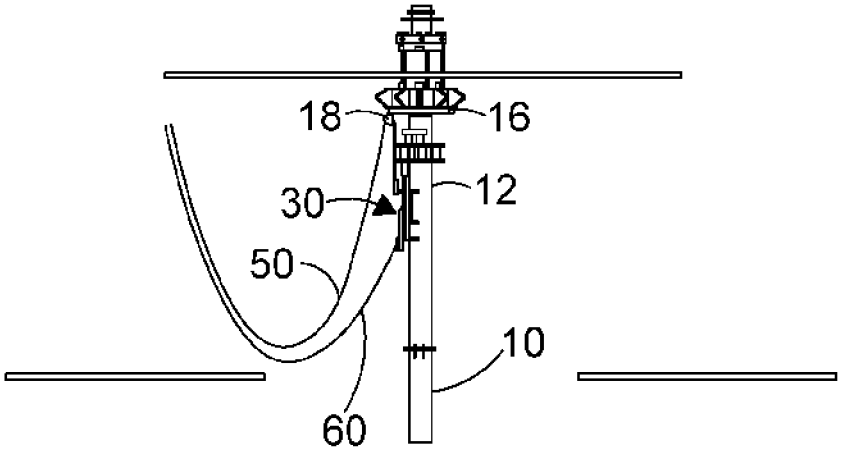

Finally in FIG. 3*f*, the ends of the control line 50 and trailing line 60 which were not attached to the up-stab bridle 30 are shown re-stowed. The procedure to run the up-stab bridle 30 onto the marine drilling riser 10 is now complete. At no point in the running procedure is an operator exposed to any significantly elevated level of risk by being required to conduct operations outside of a relatively safe working environment.

Figure 4:
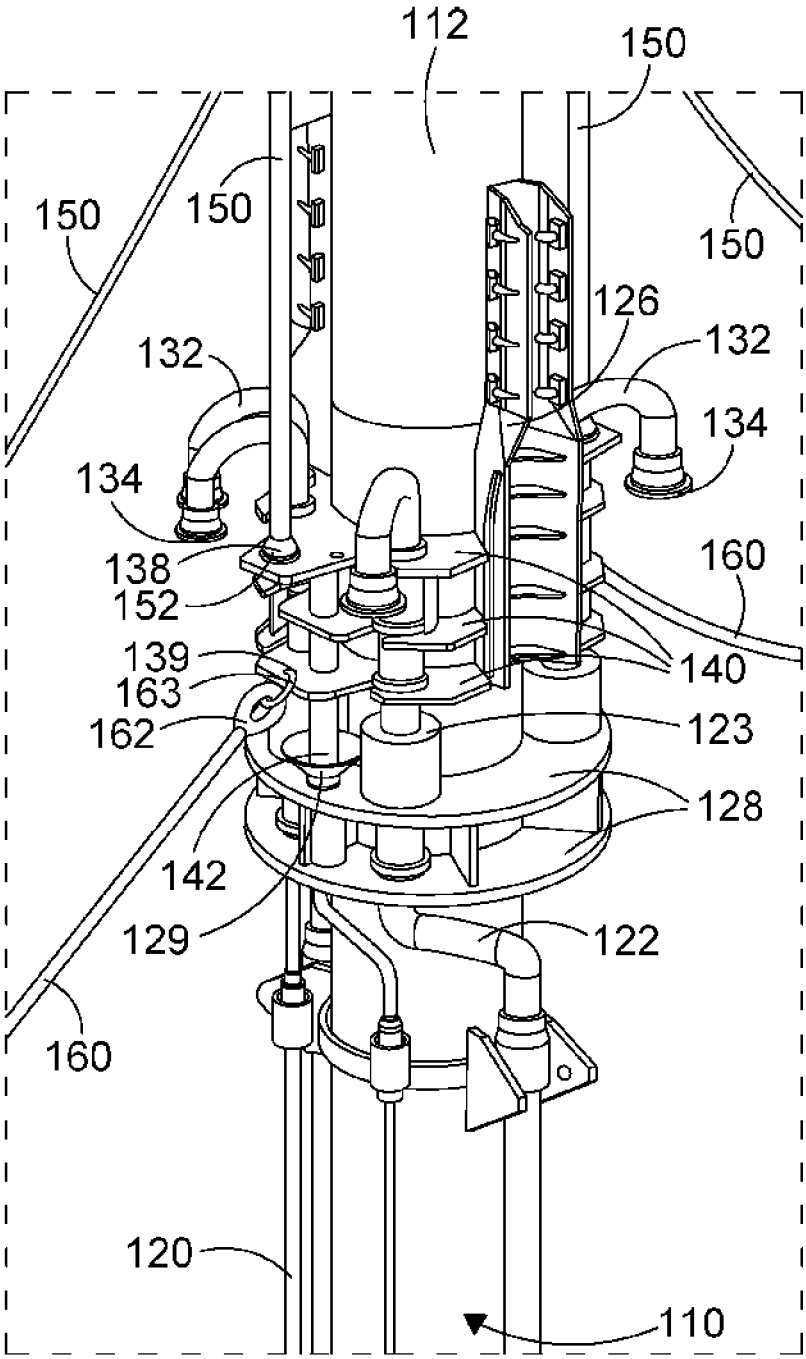
FIG. 4 is a perspective view of two down-stab coupling members engaged and sealed with the auxiliary lines of a marine drilling riser in accordance with a second embodiment of the present invention.

A second example of a connection system 101 is shown in FIG. 4. The second example is generally similar to the first example, and equivalent parts (which will not be described again in detail) are numbered similarly, but the reference numbers are increased by 100. In the second example, the marine drilling riser 110, control line 150 and tailing line 160 are equivalent in both form and function to the corresponding parts described previously in the first example.

In the second example, the coupling member or bridle 130 of the connection system 101 is a down-stab bridle which is adapted to engage with the auxiliary line connectors 123 of the marine drilling riser 110 through downward motion, or in other words, by way of movement away from the tension ring 116, as will be explained in greater detail below. By way of illustration, FIG. 4 depicts the simultaneous running of two down-stab bridles 130. The connection system 1 described previously in the first example also allows for the simultaneous running of more than one up-stab bridle 30.

The marine drilling riser 110 comprises a telescopic joint 112, tension ring 116 and one or more auxiliary lines 120 disposed on the outer surface of the riser 110. In this example the upper end of each auxiliary line 120 is disposed further from the tension ring 116 than the corresponding upper ends of the auxiliary lines 20 in the first example. Also, each auxiliary line 120 in this example is joined directly to its respective auxiliary line end portion 122. The auxiliary line end portions 122 in this example are also disposed on the outer surface of the telescopic joint 112, but in this example each auxiliary line end portion 122 comprises a pair of complementary bends, each bend being between approximately 45 degrees and 90 degrees. In other words, each auxiliary line end portion 122 approximates a Z-shape. The shape of the auxiliary line portion 122 provides less turbulence and disruption to fluid flow through the auxiliary line portion 122, compared to the pair of consecutive auxiliary line 90-degree connectors 21 of the first example, which result in a more deviated fluid flow path into the auxiliary line end portions 22 of the first example. Each auxiliary line end portion 122 is also joined to an auxiliary line connector 123 at the opposing axial end of the auxiliary line end portion 22 from its respective connected auxiliary line 120. Each auxiliary line connector 123 has an upward-facing opening, a bore and a sealing mechanism and is adapted to receive, sealingly engage and lock with a corresponding auxiliary line connector (not shown in the Figures) of the down-stab bridle 130. The auxiliary line connectors 123 are disposed parallel to the axis of the bore of the riser 110, but the Z-shaped auxiliary line end portions 122 between the auxiliary lines 120 and each respective auxiliary line connector 123 causes the auxiliary line connectors 123 to have a lesser circumferential spacing around the outer surface of the riser 110 than the auxiliary lines 120.

In this example the annular plates 128 disposed around the outer surface of the telescopic joint 112 are disposed toward the lower end of the telescopic joint 112 with a greater spacing from the tension ring 116 than the corresponding annular plates 28 of the first example. The annular plates 128 also support a guide sleeve 129 which passes through circumferentially aligned apertures in the annular plates 128. In this example the guide sleeve 129 is disposed circumferentially between the two auxiliary line connectors 123. The guide sleeve 129 has an upward-facing opening and a bore and is adapted to receive a guide stab 142 of the down-stab bridle 130.

Each down-stab bridle 130 of the second example also comprises two drape hose connectors 134 and two auxiliary line connectors joined by two tubulars 132, supported between framing plates 140, but in this example the tubulars 132 have a U-bend portion such that both the drape hose connectors 134 and the auxiliary line connectors are downward-facing. When the down-stab bridle 130 is engaged with the guide rails 126 on the outer surface of the telescopic joint 112, the U-bend tubing sections 132 are parallel with the axis of the bore of the riser 110 and circumferentially aligned with the corresponding auxiliary line end portions 122 of the riser 110. Also in this example, when the down-stab bridle 130 is engaged with the guide rails 126, the upper axial ends of the U-bend tubing sections 132 proximate the drape hose connectors 134 are radially displaced from the outer surface of the telescopic joint 112 to a greater degree than the lower axial ends of the U-bend tubing sections 132 adjacent to the auxiliary line connectors.

The down-stab bridle 130 also comprises two anchor or fixing points 138, 139, similar to the up-stab bridle 30 of the first example. In this example however, the anchor point 139 closest to the auxiliary line connectors is adapted to allow the tailing line 160 to be attached to the down-stab bridle 130, and the anchor point 138 closest to the drape line connectors 134 is adapted to allow the control line 150 to be connected to the down-stab bridle 130.

Figure 5A:
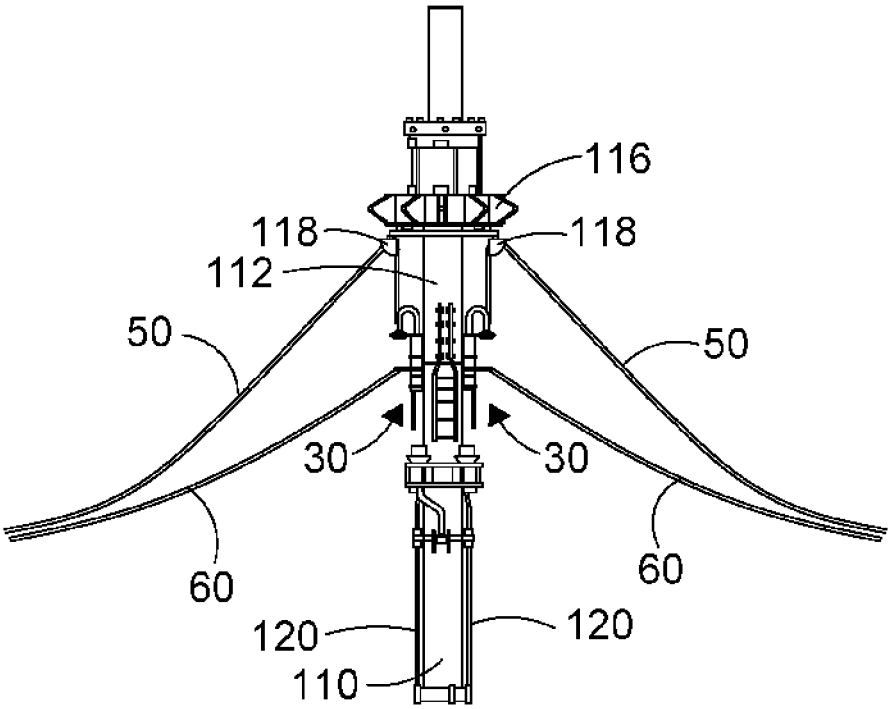
FIGS. 5*a* and 5*b* are section views of two of the steps in running a down-stab coupling member onto a marine drilling riser, and approximately correspond to FIGS. 3*d* and 3*e* of the up-stab coupling member sequence.
Figure 5B:
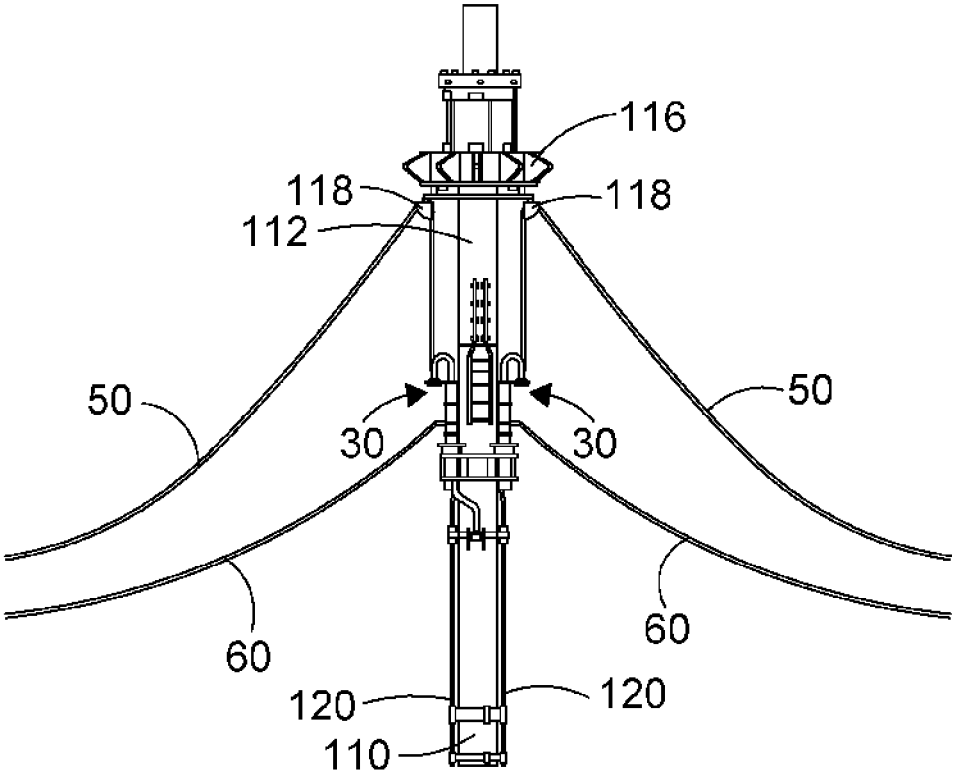

The procedure to run the down-stab bridle 130 onto the marine drilling riser 110 is shown in abbreviated form in FIGS. 5*a* and 5*b*. FIGS. 5*a* and 5*b* also depict the simultaneous running of two down-stab bridles 130. The initial sequence of steps to run the down-stab bridle 130 are substantially the same as the initial steps to run the up-stab bridle 30 in the first example, except that the detachable connector 152 at one end of the control line 150 is attached to the anchor point 138 of the down-stab bridle closest to the drape hose connectors 134, and the ferrule 162 and threaded shackle 163 at one end of the tailing line 160 are attached to the anchor point 139 of the down-stab bridle 130 closest to the auxiliary line connectors.

In FIG. 5*a* the down-stab bridle 130 has reached a position vertically below the pulley 118 on the tension ring 116 while still being suspended from the control line 150. As described previously the outer diameter of the tension ring 116 is greater than the outer diameter of the telescopic joint 112. In this example the pulley 118 is also fixed to the underside of the tension ring 116 at a location that is radially aligned with the outer diameter of the telescopic joint 112. Therefore, when the down-stab bridle 130 is freely suspended from the pulley 118, it tends toward a horizontal position that is immediately adjacent to the outer surface of the telescopic joint 112. In this position, the framing plates 140 of the down-stab bridle 130 begin to engage with the guide rails 126 fixed to the outer surface of the telescopic joint 112.

In FIG. 5*b* the down-stab bridle 130 is shown continuing to be lowered vertically down the outer surface of the telescopic joint 112. The framing plates 140 of the down-stab bridle 130 are engaged with the guide rails 126 which restrict the movement of the down-stab bridle 130 relative to the telescopic joint 112 to vertical movement only, or in other words, to movement that is parallel to the axis of the bore of the marine drilling riser 110. The guide rails 126 engaged with the down-stab bridle 130 prevent horizontal displacement of the down-stab bridle 130 perpendicular to the axis of the bore of the riser 110, so that the auxiliary line connectors of the down-stab bridle 130 are vertically aligned with the auxiliary line connectors 123 of the riser 110. Therefore, as the down-stab bridle 130 is vertically lowered toward its final position on the outer surface of the telescopic joint 112, the auxiliary line connectors of the down-stab bridle 130 engage with the auxiliary line connectors 123 of the riser 110. The auxiliary line connectors are received through the openings of the auxiliary line connectors 123 and into their respective bores. Once the down-stab bridle 130 has been fully lowered to the extent of its vertical movement and the auxiliary line connectors are fully homed within the bores of the auxiliary line connectors 123, the sealing mechanisms of the auxiliary line connectors 123 are actuated to seal and lock the connections between the auxiliary line connectors and the auxiliary line connectors 123. Thus, fluid communication is allowed from the drape hoses, through the U-bend tubing sections 132 of the down-stab bridle 130, through the auxiliary line end portions 122 and into the auxiliary lines 120 of the marine drilling riser 110.

Figure 6A:
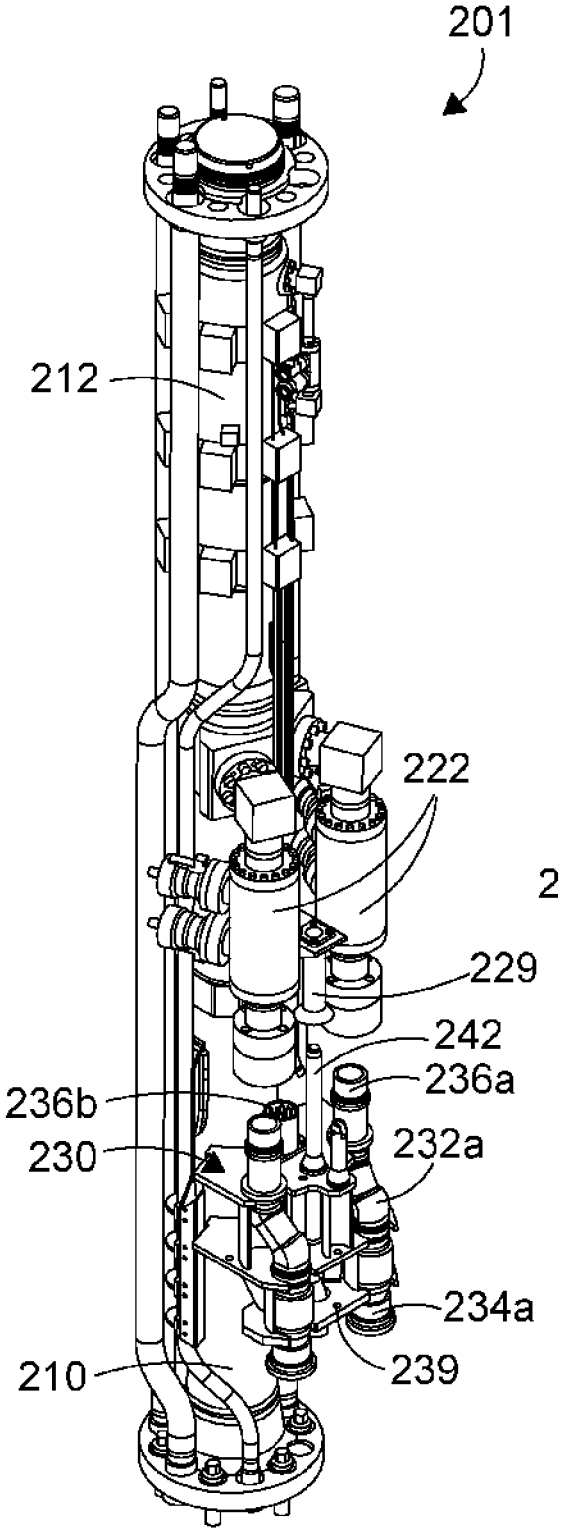
FIGS. 6*a* and 6*b* are upper and lower perspective views of a marine drilling riser in accordance with a third embodiment of the present invention.
Figure 6B:
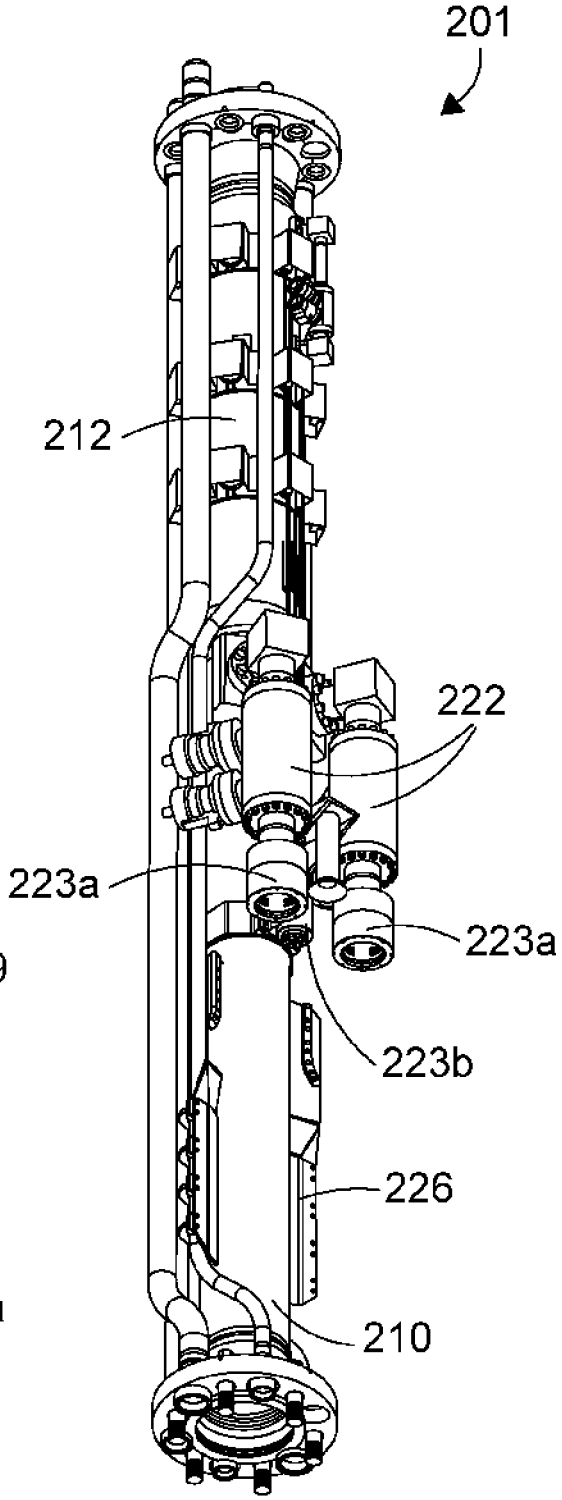

A third example of a connection system 201 is shown in FIGS. 6*a* and 6*b*. The third example is generally similar to the first example, and equivalent parts (which will not be described again in detail) are numbered similarly, but the reference numbers are increased by 100. In the third example, the marine drilling riser 210 is equivalent in both form and function to the corresponding part described previously.

In the third example, the coupling member or bridle 230 of the connection system 201 is an up-stab bridle, similar to the up-stab bridle 30 of the first example, but in this example, the up-stab bridle 230 comprises an electrical auxiliary line connector 236*b* (first umbilical stab plate), in addition to the fluid auxiliary line connectors 236*a*. In this example there are two fluid auxiliary line connectors 236*a* and one electrical auxiliary line connector 236*b*. but in other examples there may be fewer or more of each type of connector.

The up-stab bridle 230 is shown in FIGS. 6*a* and 6*b* positioned adjacent to and in contact with the telescopic joint 212 of the marine drilling riser 210, but with the auxiliary line connectors 236*a*, 236*b* of the up-stab bridle 230 not yet engaged with the auxiliary line connectors 223*a*, 223*b* (second umbilical stab plate) of the auxiliary line end portions 222. In this example the up-stab bridle 230 comprises two gooseneck tubing sections 232*a* rigidly supported between three framing plates 240, and a gooseneck conduit or housing 232*b*, similarly supported between the framing plates 240. Also in this example, the up-stab bridle 230 comprises a guide stab 242 disposed parallel to, and intermediate of, the gooseneck tubing sections and gooseneck conduits 232*a*, 232*b*.

As best seen in FIG. 6*a*, when the up-stab bridle 230 is engaged with the guide rails 226 mounted on the outer surface of the telescopic joint 212, the upper axial ends of the gooseneck tubing sections 232*a*, 232*b* proximate the auxiliary line connectors 236*a*, 236*b* are radially displaced from the outer surface of the telescopic joint 212 to a lesser degree than the lower axial ends of the gooseneck tubing sections 232*a*, 232*b* proximate the corresponding drape hose connectors 234*a*, 234*b*. Also in this example, both the electrical auxiliary line connector 236*b* and electrical drape hose connector (or umbilical line connector) 234*b* are radially displaced from the outer surface of the telescopic joint to a lesser degree that the corresponding fluid auxiliary line connector 236*a* and fluid drape hose connectors 234*a*, but in other examples the electrical drape hose connector (or umbilical line connector) 234*b* may have greater or equal radial displacement than the fluid drape hose connectors 234*a*, or the electrical drape hose connector (or umbilical line connector) 234*b* may even be positioned to allow connection of an umbilical line to the side or upper surfaces of the up-stab bridle 230.

Figure 7A:
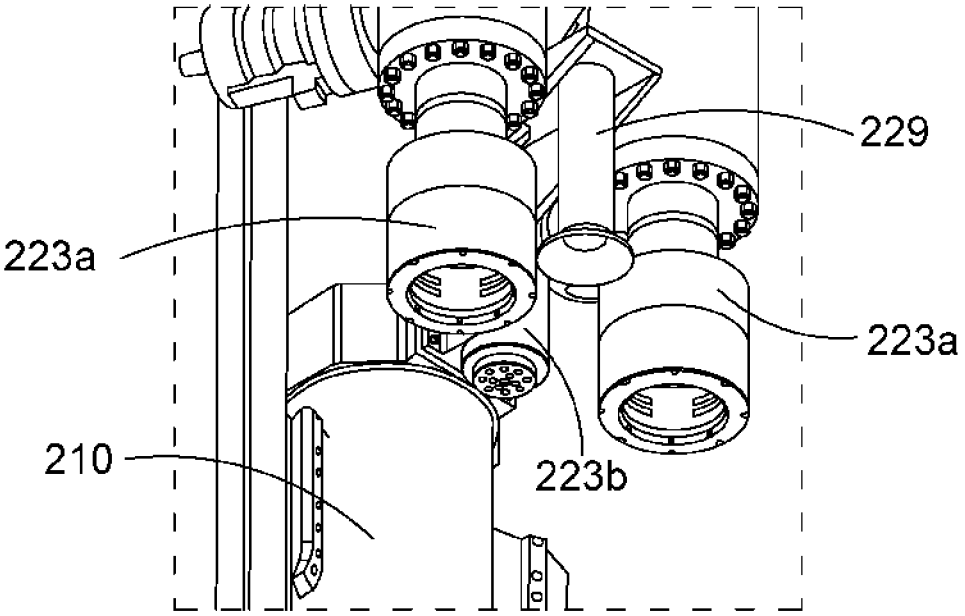
FIGS. 7*a* and 7*b* are detailed perspective views of the fluid and electrical auxiliary line connectors of the marine drilling riser and up-stab coupling member shown in FIGS. 6*a* and 6*b*.
Figure 7B:
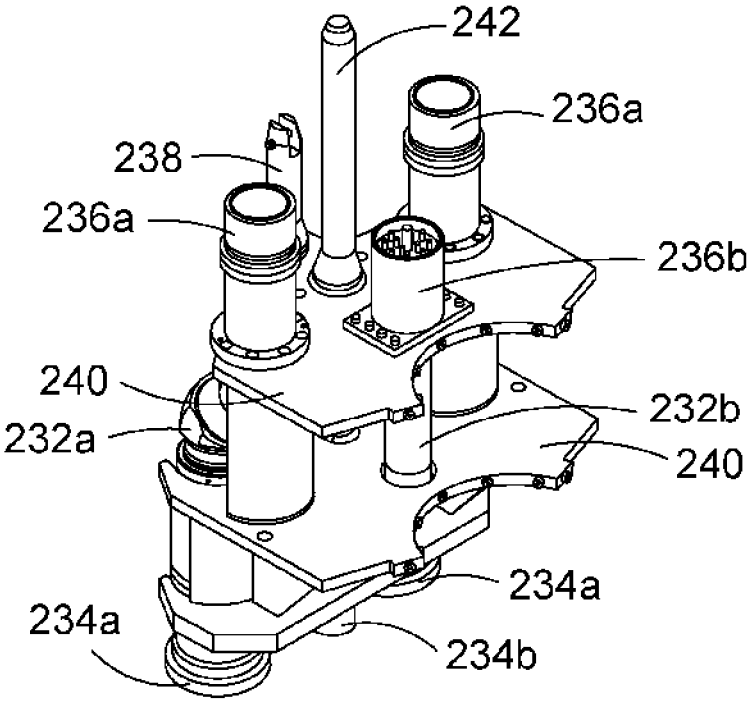

As shown in FIGS. 7*a* and 7*b*, the up-stab bridle 230 also comprises a winch point 238, and an anchor or fixing eye 239 (best seen in FIG. 6*a*) disposed on the lower framing plate 240. The winch and anchor points 238, 239 are adapted to allow a control line and a tailing line (not shown in FIGS. 6*a*, 6*b*, 7*a* and 7*b*) to be attached to the up-stab bridle 230. In this example the winch and anchor points 238, 239 are spaced from one another at opposing ends of the up-stab bridle 230, and are also substantially spaced from the centre of gravity of the up-stab bridle 230, so that the up-stab bridle 230 maintains a stable orientation when suspended from winch point 238.

In this example of a connection system 201, as in the first example, the winch point 238 is adapted to allow the control line to be attached to the up-stab bridle 230, and the anchor point 239 is adapted to allow the tailing line to be attached to the up-stab bridle 230.

The procedure to run the up-stab bridle 230 onto the marine drilling riser 210 is substantially the same as the procedure described above for the first example of an up-stab bridle 30, shown as a sequence of steps in FIGS. 3*a* to 3*f* In this example, when the up-stab bridle 230 is raised vertically up the outer surface of the telescopic joint 212, in a manner similar to that seen in FIGS. 3*d* and 3*e* for the first example, the guide rails 226 also restrict movement of the bridle 230 relative to the telescopic joint 212 to be parallel to the axis of the bore of the marine drilling riser 210. Thus, the guide stab 242 is aligned with a guide sleeve 229 fixed to the outer surface of the riser 210, and the auxiliary line connectors 236*a*, 236*b* of the up-stab bridle 230 are aligned with the auxiliary line connectors 223*a*, 223*b* of the riser 210. As the bridle 230 is raised vertically toward its final position, the guide stab 242 is first received within the guide sleeve 229, and then the auxiliary line connectors 236*a*, 236*b* of the up-stab bridle 230 engage with the auxiliary line connectors 223*a*, 223*b* of the riser 210. The fluid auxiliary line connectors 236*a* are first received through the openings of the fluid auxiliary line connectors 223*a* and into their respective bores, and then the electrical auxiliary line connector 223*b* of the riser 210 is received into the electrical auxiliary line connector 236*b* of the up-stab bridle 230. Once the up-stab bridle 230 has been fully raised to the extent of its vertical movement (e.g. fully landed) and the auxiliary line connectors 236*a*, 236*b* of the up-stab bridle 230 are fully homed with the corresponding auxiliary line connectors 223*a*, 223*b* of the riser 210, the hydraulic sealing mechanisms of the fluid auxiliary line connectors 223*a* are actuated to seal and lock the connections between the auxiliary line connectors 236*a*, 236*b* and the auxiliary line connectors 223*a*, 223*b*. Thus, fluid communication is established from the drape hoses, through the gooseneck tubing sections 232*a* of the up-stab bridle 230 and into the auxiliary line connectors 223*a*, and electrical connections are established from an umbilical or other cable connected to the drape line connector 234*b*, through the gooseneck conduit 232*b* of the up-stab bridle and into the auxiliary line connector 223*b*.

The invention claimed is:

1. A connection system for a marine drilling riser having one or more auxiliary lines, the connection system comprising:

a moveable coupling member having at least one first connector and at least one second connector coupled to the at least one first connector, wherein the at least one second connector is adapted for engaging with at least one connector of an auxiliary line of the one or more auxiliary lines of the marine drilling riser;

the connection system further comprising a control line support for fixing at or adjacent an outer surface of the marine drilling riser;

a flexible control line supported by the control line support and for attachment to the moveable coupling member; and a flexible tailing line for attachment to the moveable coupling member, the control line and tailing line being provided for controlling movement of the moveable coupling member towards and away from the riser.

2. A connection system as claimed in claim 1, wherein the control line support is fixable to a lower surface of a tension ring of the marine drilling riser.

3. A connection system as claimed in 2, wherein the control line support is mountable for radial displacement from an axis of the marine drilling riser but within an outer diameter of the tension ring.

4. A connection system as claimed in claim 2, wherein the control line support is mountable for radial displacement from an axis of the marine drilling riser substantially in alignment with an outer diameter of a telescopic joint of the marine drilling riser.

5. A connection system as claimed in claim 1, wherein the control line support is mountable on the marine drilling riser.

6. A connection system as claimed in claim 1, wherein the control line support comprises a pulley.

7. A connection system as claimed in claim 1, wherein the control line and the tailing line are attachable to opposing portions of the moveable coupling member.

8. A connection system as claimed in claim 1, wherein at least one of the control line and the tailing line are attachable to the moveable coupling member at a location substantially spaced from the centre of gravity of the moveable coupling member.

9. A connection system as claimed in claim 1, wherein the at least one second connector of the moveable coupling member is adapted to form a sealed fluid conduit with the at least one connector of the marine drilling riser.

10. A connection system as claimed in claim 1, wherein the at least one second connector of the moveable coupling member is adapted to form an electrical connection with the at least one connector of the marine drilling riser.

11. A connection system as claimed in claim 1, wherein the at least one second connector of the moveable coupling member in use engages with the at least one connector of the marine drilling riser by means of an upward relative sliding movement in the direction of an axis of the marine drilling riser.

12. A connection system as claimed in claim 1, wherein the at least one second connector of the moveable coupling member in use engages with the at least one connector of the marine drilling riser by means of a downward relative sliding movement in the direction of an axis of the marine drilling riser.

13. A connection system as claimed in claim 11, wherein the relative sliding movement of the moveable coupling member is guided by a first guidance means mountable on the marine drilling riser.

14. A connection system as claimed in claim 13, wherein the first guidance means comprises a rail or track.

15. A connection system as claimed in claim 11, wherein the relative sliding movement of the moveable coupling member is guided by a second guidance means mountable on the movable coupling member.

16. A connection system as claimed in claim 15, wherein the second guidance means comprises a rod that protrudes from the movable coupling member for engagement with an aperture in the marine drilling riser.

17. A connection system as claimed in claim 1, wherein the tailing line is in use manipulated to further control the movement of the moveable coupling member as the movable coupling member is raised toward the marine drilling riser by the control line.

18. A method of running a moveable coupling member onto a marine drilling riser having one or more auxiliary lines, wherein the moveable coupling member has at least one first connector and at least one second connector coupled to the first connector, and wherein the marine drilling riser has at least one connector of an auxiliary line, a control line support for fixing at or adjacent an outer surface of the marine drilling riser, and a control line supported by the control line support, the method comprising the steps of:

attaching the control line to the moveable coupling member;

attaching a tailing line to the moveable coupling member;

tensioning the control line to raise the moveable coupling member toward the marine drilling riser until the moveable coupling member contacts an outer surface of the marine drilling riser;

manipulating the control line to move the moveable coupling member in a direction parallel to an axis of the marine drilling riser;

and engaging the at least one second connector of the moveable coupling member with the at least one connector of the auxiliary line of the marine drilling riser.

19. A method of running a moveable coupling member onto a marine drilling riser as claimed in claim 18, including tensioning the tailing line to further control the movement of the moveable coupling member as the movable coupling member is raised toward the marine drilling riser.

20. A method of running a moveable coupling member onto a marine drilling riser as claimed in claim 18, wherein the control line is attached to a forward portion of the moveable coupling member proximate the at least one second connector, and wherein the tailing line is attached to a rearward portion of the moveable coupling member proximate the at least one first connector.

21. A method of running a moveable coupling member onto a marine drilling riser as claimed in claim 18, wherein the control line is attached to a rearward portion of the moveable coupling member proximate the at least one first connector, and wherein the tailing line is attached to a forward portion of the moveable coupling member proximate the at least one second connector.

22. A method of running a moveable coupling member onto a marine drilling riser as claimed in claim 18, wherein the coupling member engages a guidance means provided to the marine drilling riser to align the coupling member for connection with the at least one connector of the auxiliary line of the marine drilling riser.

23. A method of running a moveable coupling member onto a marine drilling riser as claimed in claim 18, wherein the at least one second connector of the moveable coupling member is adapted to form a sealed fluid conduit with the at least one connector of the marine drilling riser.

24. A method of running a moveable coupling member onto a marine drilling riser as claimed in claim 18, wherein the at least one second connector of the moveable coupling member is adapted to form an electrical connection with the at least one connector of the marine drilling riser.

* * * * *